United States Patent [19]

Woods

[11] Patent Number: 4,703,953

[45] Date of Patent: Nov. 3, 1987

[54] NOTE PAPER DISPENSING AND RECORD RETAINING DEVICE

[76] Inventor: Bill R. Woods, 1382 Valencia Ave., Tustin, Calif. 92680

[21] Appl. No.: 947,105

[22] Filed: Dec. 29, 1986

[51] Int. Cl.[4] ..... B41L 5/00; B41L 5/04; B42D 19/00; B41F 13/54

[52] U.S. Cl. ..... 282/5; 282/16 C; 281/6; 101/225

[58] Field of Search ..... 282/3 A, 5, 15 B, 16 C; 226/80, 86; 346/19, 136, 145; 101/43, 225, 227, 226, 228, 222, 230; D18/21; 281/6

[56] References Cited

U.S. PATENT DOCUMENTS

| | | | |
|---|---|---|---|
| 1,959,943 | 5/1934 | Barker | 282/16 C |
| 2,021,681 | 11/1935 | Bright . | |
| 2,149,006 | 2/1939 | Borchers . | |
| 2,183,778 | 12/1939 | Sheppard et al. | 282/16 C |
| 2,326,109 | 8/1943 | Waechter . | |
| 2,326,110 | 8/1943 | Waechter | 282/16 C |
| 2,337,548 | 12/1943 | Davidson et al. | 282/16 C |
| 2,622,898 | 12/1952 | Uline . | |
| 2,707,644 | 5/1955 | Uline . | |
| 3,004,775 | 10/1961 | Schliemann . | |
| 3,235,288 | 2/1966 | Deerfield | 282/5 |

FOREIGN PATENT DOCUMENTS

| | | | |
|---|---|---|---|
| 30714 | 5/1960 | Finland | 282/16 C |
| 2062543 | 5/1981 | United Kingdom | 281/6 |

*Primary Examiner*—E. R. Kazenske
*Assistant Examiner*—Paul M. Heyrana, Sr.
*Attorney, Agent, or Firm*—Gordon K. Anderson

[57] ABSTRACT

A note dispensing and retaining device which has an open topped main body (20) with a writing platform (28) pivoted outward from the body and a continuous roll of paper (38) between spindles routed over and through the platform. An open ended roll of paper (46) is directed over the top of the continuous roll and written upon with the characters transferred to the paper underneath which is set in motion by an electrical drive mechanism with a gear motor (48). The note is stored within the device on the roll and the motor allows the past notes to be scrolled through in forward or reverse direction. A top enclosure (66) covers the device and includes a hinged compression roller (82) that engages the papers driving them simultaneously in a linear direction. The object of the invention provides paper for written notes with a copy retained within for future reference.

10 Claims, 15 Drawing Figures

NOTE PAPER DISPENSING AND RECORD RETAINING DEVICE

TECHNICAL FIELD

The present invention relates to note dispensing devices in general. More specifically to improvements in paper dispensing, record retaining chirographical note apparatus having a self-contained drive mechanism and an integral clock, calculator and calendar.

BACKGROUND ART

Previously, many types of record retaining devices have been in use endeavoring to provide an effective means for writing and storing the information within. The most prevalent has been the autographic registers which utilize the so called flat pack of superimposed multi-sheet continuous printed forms which are assembled in zigzag formation. The forms are written upon and carbon paper transfers the indica to all of the sheets which are manually ejected from the device with one copy retained within.

Other attempts to fill the need for a note retaining mechanism include the so called AUTO-DIRECTORY, manufactured in Japan by WACO, which provides a motor driven scroll of continuous paper for note retension, however, the note is retained and no copy is issued from the device.

A search of the prior art did not disclose any patents that read directly on the claims of the instant invention, however, the following U.S. Patents were considered related:

| U.S. Pat. No. | Inventor | Issue Date |
|---|---|---|
| 3,004,775 | Schliemann | Oct. 17, 1961 |
| 2,707,644 | Uline | May 03, 1955 |
| 2,622,898 | Uline | Dec. 23, 1952 |
| 2,326,109 | Waechter | Aug. 10, 1943 |
| 2,149,006 | Borchers | Feb. 28, 1939 |
| 2,021,681 | Bright | Nov. 19, 1935 |

Schliemann teaches an autographic register of the type heretofore described with a supply compartment for the flat pack, a supply table, and a feed mechanism for separating the forms and collecting one copy in a bin in an inverted foled position while dispensing the remainder.

Uline in U.S. Pat. No. 2,707,644 utilizes a portable pocket carrying autographic register with a locked lead seal preventing unauthorized access to the original and carbon copy of the ticket. A handwheel causes the original web to be wound on a roller feeding the carbon paper and the original from the machine while retaining the copy.

Uline U.S. Pat. No. 2,622,898 practices a similar device with basic features, as above.

Waechter provides a device that feeds various lengths of mainifolded forms in an autographic register with cooperating sets of discs or rolls operated by a hand crank.

Borchers teaches a manifolding device, not unlike the above discussed autographic registers, with the feeding means for the record strips, including annular or rotary elements conjointly operated. This allows the casing to be made in a vertical plane with horizontal walls and a flush top. The mechanism is again operated by a hand crank.

Finally, Bright discloses a device allowing the feeder to be released from lock holding cooperation of the folded paper record strips when an abnormal condition occurs, such as breaks or tears in the continuity of the strip.

It will be noted that all of the above prior art relies upon manual operation and only a portion of the paper is retained in strip form. Further, specific length prepunched paper in multi-sheet form is required for operation and access is provided only by removal of the paper and hand manipulation to locate the desired portion of the continual strip.

DISCLOSURE OF THE INVENTION

Notes and memos have, in the past, been written on pads of individual paper or specific forms having either carbon paper interleaved between individual sheets or pressure sensitive transfer paper in multiple order. Where individual sheets are utilized, a record is not made at all and must be reproduced by machine, if a copy is to be retained. Further, if specific forms are used, the copy is usually not kept in any specific location and may become misplaced or unavailable when needed. A primary object of the invention is to provide a permanent record of all memos or notes written by a specific individual or group on a convenient roll of paper that may be scrolled backward and displayed at any time, and easily be stored in roll form for future reference. If a copy is required of the original memo, a machine copy may be made, as before.

An important object of the invention not only allows the record to be retained, but accomplishes this feature automatically, as the device electrically issues the written memo and keeps a copy underneath in a roll simultaneously. This is achieved by the use of an electric motor that drives both an open ended roll of paper and a continuous paper roll in a linear direction by simply depressing a directional push button switch. The motor is energized by either a set of direct current storage batteries, or an A.C. to D.C. converter plugged into a facility convenience electrical outlet. The previously stored information is easily reviewed by scrolling through the past notes, as driven by the motor in either direction. A sharp edged tear plate allows the written note to be easily removed from the device.

Another object of the invention allows the actual writing surface to be planar with the desk or table top on which the device is resting. As noted above, prior art utilizes structure under the device to supply paper and accomplish the rotational or linear movement. This is not so with the instant invention, as the writing platform is raised only slightly, just enough to form a double or hollow pair of plates, allowing the rolled paper to rest on top to be written on and the copy move underneath back into the storage portion of the device. This configuration allows the writers hand to be almost on the same level as the surface upon which it is resting, providing an easy to use convenient location for writing.

Not only does the invention provide for note dispensing paper and record retension, but still another object includes the convenience of such pertinent data as a calendar that is included in the top enclosure with tear-off sheets for each month allowing forthcoming dates to be easily ascertained. Also, a self-contained calculator with an integral clock allows the time of the day to be indicated constantly, with mathmatical calculations easily computed. Further, a recess in the top enclosure above the calendar provides a retainer for a pencil or pen for writing the note or memo. As the device is tilted upward at an approximate 30 degree angle, all of the indica of the calendar, clock, and mathmatical readout, is clearly visible to the user and the location of the calculator is convenient, making the entire work station comfortable and handy to use.

Yet another object of the invention provides easy storage and portability, as the device folds up into a compact package with the leg retracted into the main body and the writing platform folding into the top enclosure. The platform is held in place with a convenient pair of magnet latches. The space required for storage is minimized and, further, the platform may be retracted closed while sitting on a desk top providing better utilization of space with easy unlatching and rotation to a horizontal position of the platform when a note is to be written. The size of the invention allows it to be easily carried in a briefcase for transportation and may be particularly useful to marketing personnel that require a copy of their communications to be retained and, yet, be available in a convenient location while in the field.

A further object of the invention is the ease of use, as it is intuitively obvious in its operation. The leg is simply extended, and the platform is pulled from the attraction of the magnets and rotated outwardly exposing the calendar and writing implement. The tear plate rotates upwardly to easily retain the top rolled paper and its use to sever the paper is obvious. Once the device has been reloaded with the two rolls of paper utilizing the directions furnished, repeated replenishing of the paper supply is easily accomplished and easy to render.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
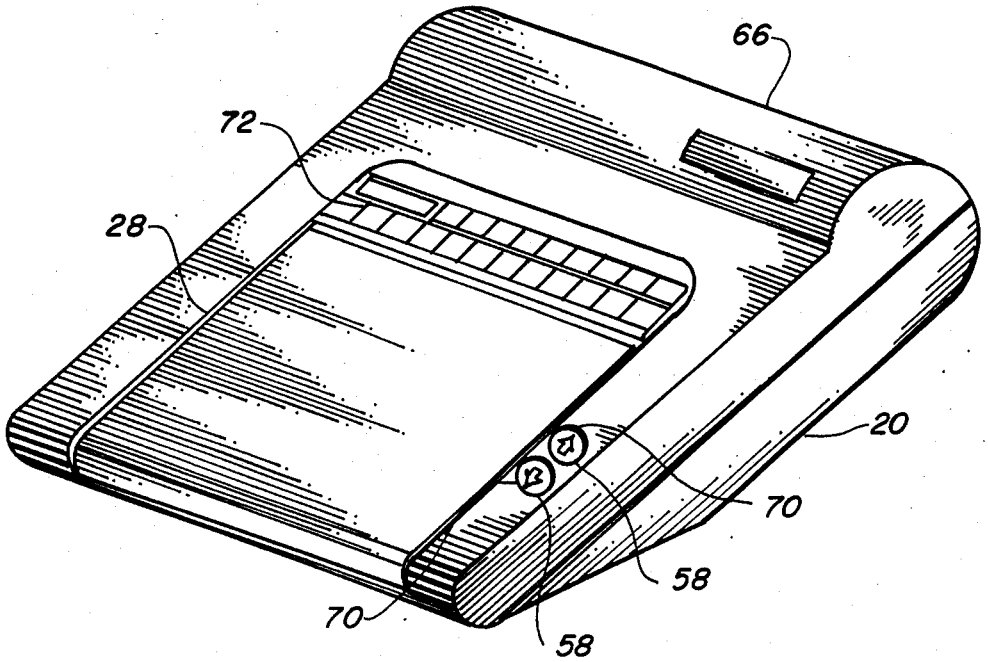
FIG. 1 is a partial isometric view of the preferred embodiment shown in its closed position for storage or transportation.
Figure 2:
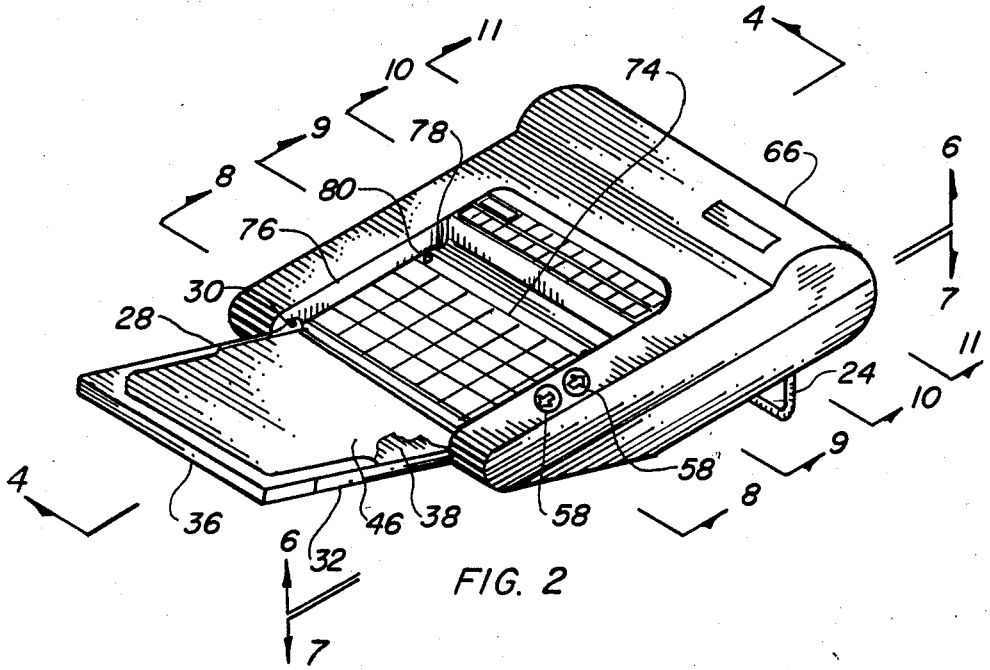
FIG. 2 is a partial isometric view of the preferred embodiment illustrated in its normally opened position with the support leg extended and the writing platform rotated outwardly.
Figure 3:
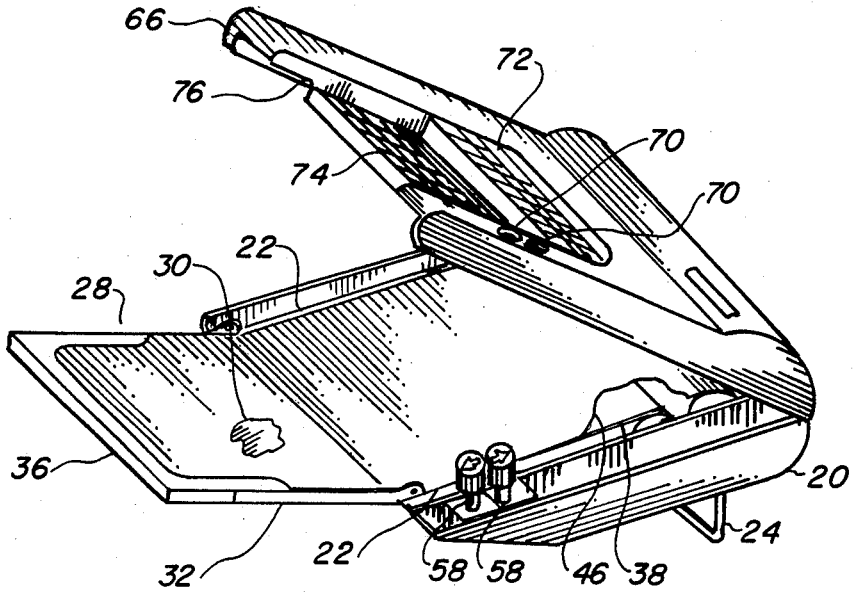
FIG. 3 is a partial isometric view of the preferred embodiment in the open position with the top enclosure hinged upwardly exposing the paper on the inside.
Figure 4:
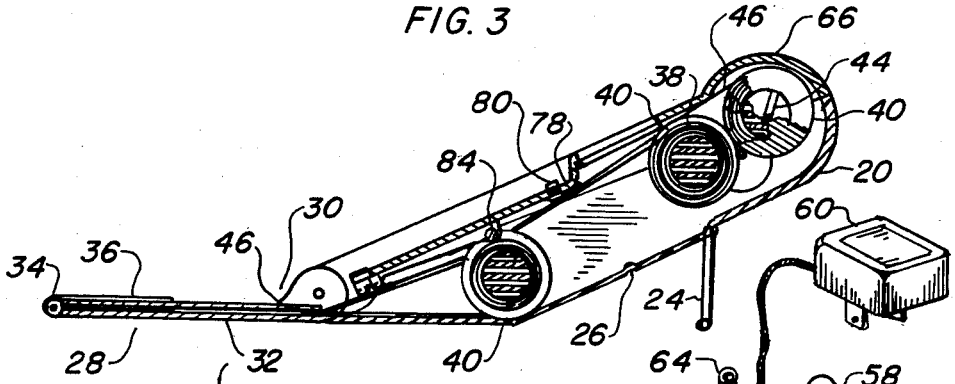
FIG. 4 is a cross-sectional view taken along lines 4—4 of FIG. 2.

The best mode for carrying out the invention is presented in terms of a preferred embodiment. The preferred embodiment, as shown in FIGS. 1 through 12, is comprised of main body member 20 that has an open top with planar sides and ends and an enclosed solid bottom. A pair of support plates 22 are affixed within the body 20 parallel to the sides and contiguous with the bottom. The support plates 22 divide the inside of the body into three separate chambers with the one in the middle largest. The bottom of the main body 20 is basically flat for resting on a smooth surface, however, one end is mitered angularly to a sharp apex, allowing the bottom to rest parallel to the top, or angular, on the mitered portion as required by the mode of use. A pivotal support leg 24 is attached at the bottom of the body 20 into a slightly raised area, as shown in FIG. 4. The leg 24 may be of any configuration, such as a solid plate, or an angular bar, with a metallic wireform being preferred. This embodiment utilizes an electrodeposited plating surface on a carbon steel rod or a stainless steel wire formed into a C-shape with the ends penetrating the body 20. The body 20 further contains a recess in the raised area allowing the leg 24 to be juxtaposed flush with the bottom when it is retracted. In the extended position the leg is angular to the bottom, as shown pictorially in FIG. 4, however, it is at right angles to the surface upon which it is resting. An integral stop is included in the main body with a slight bend in the leg 24 interfacing to impede its rotational travel.

A hollow writing platform 28 is pivotally affixed on one end between the support plates 22 allowing limited rotational movement. One end of the contained travel is planar with the mitered angular end of the body 20, and the other is restricted by interfacing with other structure on the top. This movement allows the platform 28 to be rotated outwardly for writing thereupon and inwardly for storage when not in use. The hollow portion is formed with a table surface 30 on the top and a horizontal plate 32 on the bottom, allowing a parallel space therebetween. A platform roller 34 is rotatably located on the end of the platform 28 opposite the pivotal connection to the body 20. This roller is only slightly larger in diameter than the table surface of the platform 28, allowing paper to be rolled on the surface changing directions from the top to the bottom of the table surface. A metallic paper tear plate 36 is pivotally disposed on a projecting end of the platform 28. This tear plate 36 contains a pair of angular fingers projecting toward the main body 20 and a sharp edge on the end parallel with the platform. The edge defines a cutting surface suitable for tearing paper and a space is provided between the plate 36 and platform 28 for paper to travel freely therebetween. The pivoting arrangement further allows the entire platform to rotate outwardly for writing upon and folds into the main body 20 for storage.

Figure 12:
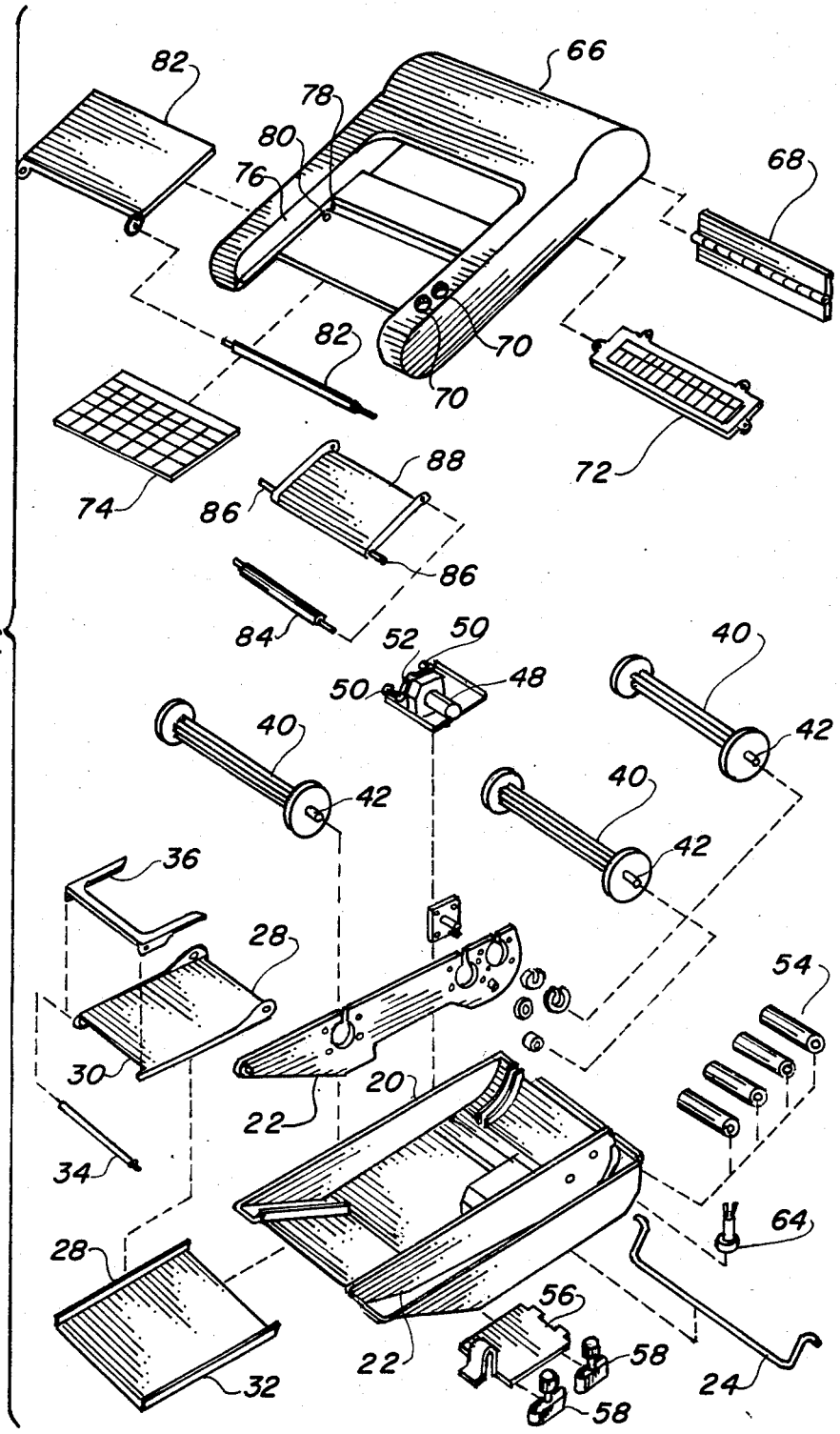
FIG. 12 is an exploded view of the invention with each major component shown individually and their relation to the other elements is depicted by dashed lines.
Figure 13:
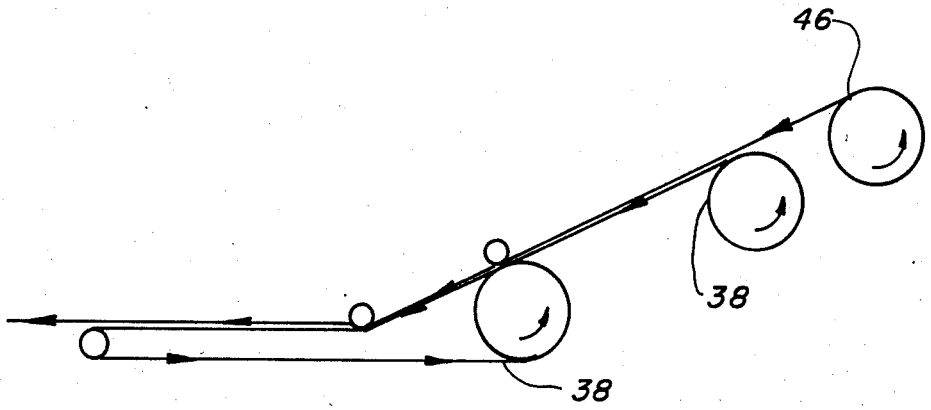
FIG. 13 is a schematic diagram of the flow of paper in the outward direction.
Figure 14:
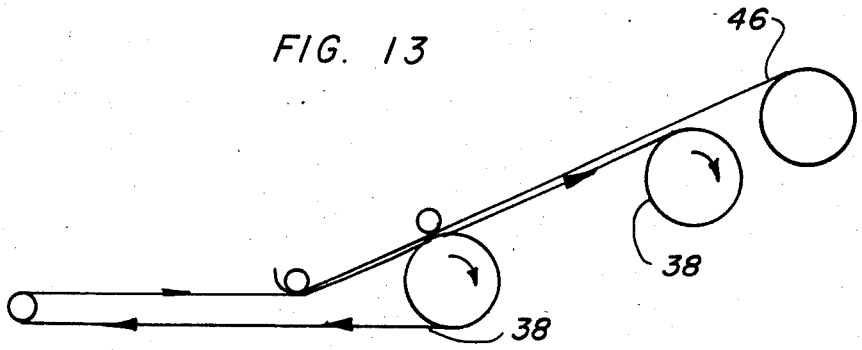
FIG. 14 is a schematic diagram of the flow of paper in the reverse or scrolling through direction.

A continuous roll of paper 38 is connected on each end to a pair of spindles 40. These spindles 40 are formed as a multi-ribbed cylinder with a flange on each end and a round projecting head 42 on one flange and a drive finger 44 on the other. These spindles 40 are best depicted in FIG. 12 where they are removed from the invention and do not include the roll of paper, as do the other views. The spindles 40 may also be hollow cylinders with a slot for retaining the paper end, or may be solid in nature with no effect upon the function of the invention. In any event, the round head 42 provides a pivot point for rotation and the drive finger 44 allows the spindle 40 to be mechanically rotated. The ribs further provide the indexing and attaching point for the paper between the two identical spindles, becoming a continuous roll of paper 38 when attached on each end to the accompanying spindles 40. The flanges on each end of the spindle 40 confine the paper in the roll regardless of the amount retained within the configuration limits. The roll of paper 38 has uninterrupted communication between the spindles 40, which are located in parallel relationship between the support plates 22. The paper starts from the first spindle 40 near the enclosed end, as illustrated in FIG. 4, and travels over the top of the second spindle 40 to the exterior of the writing platform 28 contiguously, but slideably, engaging the table surface 30 where information is handwritten thereupon. The paper then continues around the platform roller 34 where it reverses direction and enters the hollow portion of the platform 28 between the table surface 30 and the bottom plate 32, then on to the second spindle 40. This allows the paper to be attached to both spindles 40 and be rotated in either direction for reviewing the notes that are transcribed on the continuous roll. It will be seen that the paper is guided in its travels by flanges, tunnels and rollers to maintain its direction and integrity.

An open ended roll of paper 46 is stored on a spindle 40, as above, however, no mechanical drive is attached. The spindle 40 is free to rotate, and the paper is directed over the top of the first continuous roll 38 spindle and contiguously engages the second continuous roll 38 spindle in like manner. The paper in the roll 46 then continues over the top of the writing platform 28 on the table surface 30, where it is ejected between the tear plate 36 and the roller 34. This routing allows the paper to be juxtapositioned with the continuous roll 38 such that they are in parallel communication on the entire table surface 30. A transfer of the chirographical note written on the top roll of paper 46 to the bottom continuous roll 38 is accomplished by means well known in the art. This method includes a pressure sensitive material deposited on the underside of the open ended roll of paper 46, or the deposited material on the top surface of the continuous roll 38, with a combination of both also being acceptable. In any event, when a note is handwritten on the top surface of the roll of paper 46 with a writing instrument, such as a pen or pencil, the characters are transferred and retained on the continuous roll 38. The rolls are rotated and the top paper is expelled separately at the bottom where it may be manually torn off on the sharp edge of the tear plate 36. The information is then stored permanently on the continuous roll for future reference.

Figure 5:
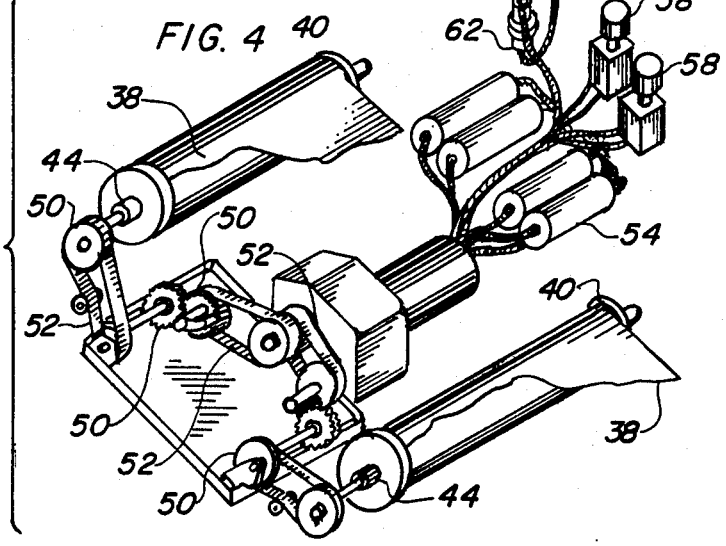
FIG. 5 is a partial isometric of the drive mechanism completely removed from the invention for clarity.
Figure 6:
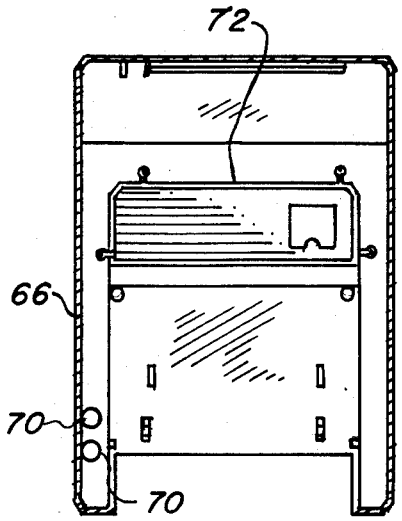
FIG. 6 is a cross-sectional view taken along lines 6—6 of FIG. 2.
Figure 7:
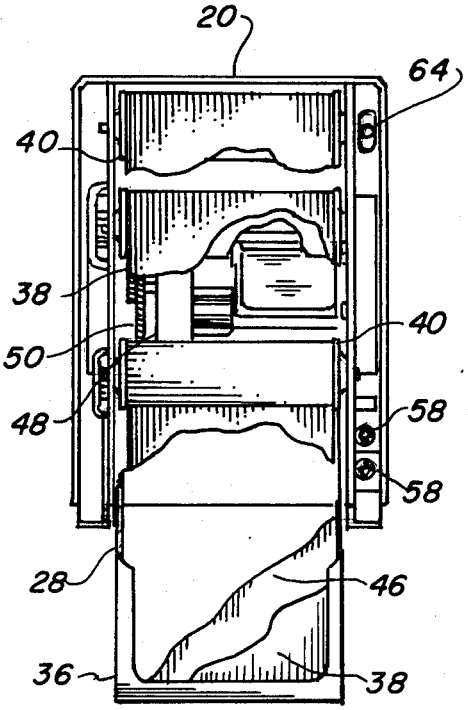
FIG. 7 is a cross-sectional view taken along lines 7—7 of FIG. 2 with portions of the paper cut-away for clarity.

A drive mechanism, pictorially illustrated in FIG. 5, completely removed from the device for clarity, rotates both spindles 40 in the continuous roll of paper 38 in either a forward or aft direction. This allows the information transferred onto the paper to roll forward for storage, or backward for review at a later time. This mechanism is electrically operated and consists of a gear motor 48 having polarity reversing directional rotation. The motor 48 is energized by direct current with an integral cluster of gears connected to the armature shaft to reduce the inherent speed of the motor. A drive shaft projects from the gear reducer and a two groove sheave is connected on the end. A number of driven gears and mating sheaves 50 are positioned between the motor 48 and the end of the continuous roll spindles 40 to accommodate the lateral displacement and transfer the directional motor torque. A pair of belts 52 in each directional linkage interface with the drive and driven gears and sheaves to accommodate this power transfer. It will be noted that the preferred embodiment is shown in FIG. 5, however, any drive motor and combination of gears and belts well known in the art may be substituted with equal ease, and the invention is not limited to this particular drive system. The electrical energy to operate the motor is furnished by a power supply package 54 consisting of a number of direct current storage batteries wired together in series and packaged within a compartment having its own separate removable door 56, best illustrated in FIG. 12. A pair of switches 58, one for forward and the other for reverse rotation, provide the control of the motor 48 by momentarily closing a contact within the switch 58, when manually depressed. This allows the current to be conducted to the motor, through connecting wiring, completing a circuit accomplishing the movement of the paper in the desired linear direction. As an alternate power supply 54, an alternating current to direct current converter 60 with a detachable plug 62 and jack 64 connector may be utilized. The jack 64 is connected through the bottom of the main body 20 and wired to the motor, and the plug 62 is removably attached through a flexible cable to the converter 60. The plug 62 is hard wired to the motor 48 paralleling the batteries 54, or isolating them completely, in an optional mode.

A top enclosure 66 is secured pivotally to the main body 20 with a hinge 68 providing a protective cover for the rolls of paper and the drive mechanism within the body 20. The top enclosure 66, best illustrated in FIGS. 1, 2, 3, 6, and 12, is formed in like manner to the main body 20 with a recessed and contoured top and relatively thin sidewalls. The hinged end is radial in shape to compensate for the open ended roll of paper 46 on the spindle 40, and the middle portion of the top is recessed directly over the paper 46 and 38. A pair of holes 70 for the switches 58 allow their protrusion when the unitary enclosure 66 is shut. Inset into the enclosure 66 is a self-contained electronic calculator 72, preferably containing an integral clock sharing a solid state digital readout, also having its own power supply in the form of a battery. The attachment to the enclosure 66 may be any method convenient for the configuration, with threaded fasteners into recessed bosses in the enclosure being preferred. This allows mathmatical calculations to be conducted, and the clock indicates the time of day.

A removable sheet printed calendar 74, having the appropriate months and year depicted in printed form, is attached to a recess 76 in the middle of the enclosure 66. The recess 76 not only provides a convenient and protected location for the calendar, but allows the writing platform 28 to rotate inwardly over the top of the calendar protecting both the calendar face and the exposed paper 46.

Integral with the recess 76, at a point between the calendar 74 and the calculator 72, is a writing implement holding depression 78. This depression 78 is below the surface of the calendar and confined within the recess 76 such that a pen or pencil may be stored easily when the platform 28 is closed and is accessible when the platform is open.

In order to maintain a closed or locked position of the platform 28 when rotated inward, a pair of magnets 80 are embedded into cavities in the recessed portion of the top enclosure 66 between the calendar 74 and the depression 78. These magnets 80 are permanent in nature and are attracted to the ferrous metal of the paper tear plate 36 that is located directly in line and juxtapositioned thereupon when the platform is closed. This arrangement not only locks the platform 28 in place, but also holds the enclosure 66 in the closed position, as the hinge and pivot point are on opposite ends of the device. Sufficient space is allowed between the platform 28 and the enclosure 66 to allow ones fingers to disengage the magnetic attraction and its operation is intuitively obvious.

Figure 8:
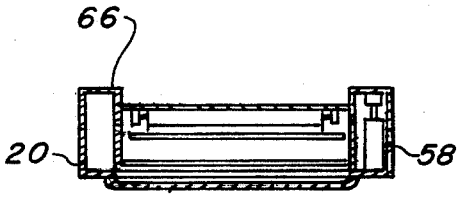
FIG. 8 is a cross-sectional view taken along lines 8—8 of FIG. 2.
Figure 9:
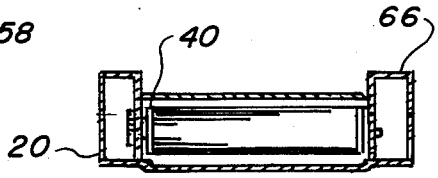
FIG. 9 is a cross-sectional view taken along lines 9—9 of FIG. 2.
Figure 10:
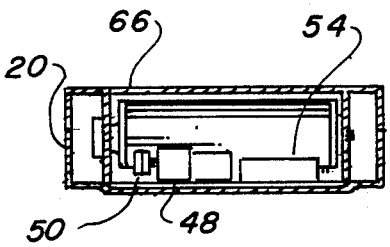
FIG. 10 is a cross-sectional view taken along lines 10—10 of FIG. 2.
Figure 11:
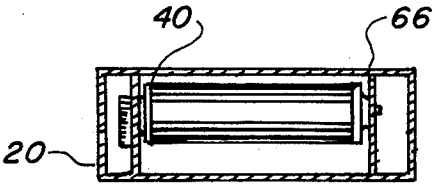
FIG. 11 is a cross-sectional view taken along lines 11—11 of FIG. 2.
Figure 15:
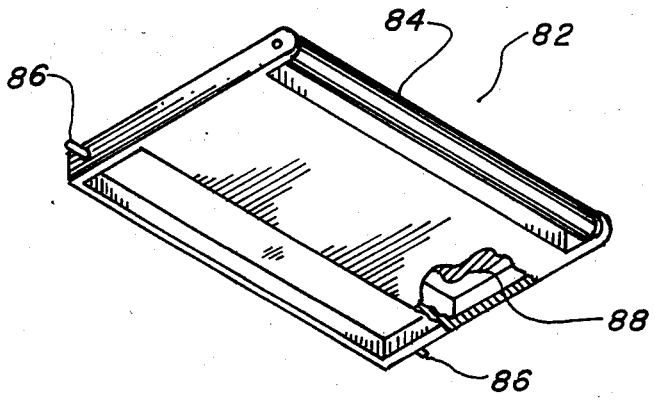
FIG. 15 is a partial isometric of the compression roller mechanism completely removed from the invention for clarity.

A compression roller mechanism 82, illustrated in FIGS. 4, 8, 12, and completely removed from the invention in FIG. 15, is pivotally attached to the underside of the enclosure 66. The roller mechanism 82 contains a compression roller 84 on one end and a pair of pivotal studs 86 on the other, with a metallic weight 88 in the middle. The weight 88 utilizes a heavy metal with a high weight to mass ratio, such as lead, lead alloy, steel, or the like. The roller mechanism 82 is pivotally attached with the studs 86 to the underside of the enclosure 66, with the roller 84 in alignment with the paper 38 and 46 on the closest continuous roll spindle 40. The metallic weight 88 has ample mass to cause sufficient force to be applied to engage the paper on the open ended roll 46 against the continuous roll paper 38 causing the open ended paper 46 to travel along with the rotated spindle 40. This arrangement allows propulsion of the paper 46 and also compensates for the difference in diameter of the continuous roll of paper 38 on the spindle 40.

The material used for the structure in the invention may be any type suitable for the application, however, most components lend themselves to a thermoplastic material having high impact strength and stiffness with good formability. This material includes acrylonitrile butadiene styrene (ABS), high impact styrenes, polypropylenes, high-density polyethylenes and cellulose acetate butyrates. Suitable materials other than thermoplastic include formed steel, cast or stamped aluminum, or magnesium, and also die cast metal alloys. The rotating components, such as the platform roller 34 and compression roller 84 are preferably made using a steel shaft with a synthetic rubber outer sheath and acetal homo-polymer bearings, known by its registered trademark DELRIN.

In operation the support leg 24 is extended and the writing platform 28 is rotated outwardly exposing the paper. A note is written on the open ended paper on the roll 46, which transfers the information to the continuous roll 38. The spindles 40 are rotated by depressing the appropriate switch 58, electrically energizing the drive mechanism which rotates the spindles 40 feeding the open ended paper beyond the device while simultaneously rolling the stored paper on the driven continuous roll 38. The extended paper is torn off against the sharp surface of the tear plate 36 and the apparatus is ready for the next note.

To read a note already recorded, the open ended paper is moved upward by rotating the tear plate 36, exposing the continuous roll of paper 38 and the switch 58 designated by the directional arrow forward or reverse is depressed scrolling through the past notes, as desired.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A paper dispensing, record retaining chirographical note apparatus comprising:

(a) a main body member having an open top, four sides, and a bottom, with a pair of support plates parallel with at least two of the sides with the bottom configured to rest on a flat surface;

(b) a hollow writing platform pivotably affixed on one end between the support plates defining a surface for writing, rotating inwardly for storage and rotating outwardly away from the main body for functional operation;

(c) a continuous roll of paper on a pair of spindles in uninterrupted communication therebetween, rotatably nested in parallel relationship between the support plates with the paper disposed over and within the hollow of the writing platform such that written information may be transferred and stored thereupon;

(d) an open ended roll of paper on a spindle, having indica communicable qualities, juxtapositioned with the continuous roll over both spindles and over the platform allowing written characters on the top to be transferred to the continuous roll of paper underneath for storage and future reference;

(e) a drive mechanism to rotate both spindles on said continuous roll of paper in either a forward or aft direction to store the characters transferred onto the paper after it is written and to roll backwards to review the information when aligned on the platform, at a later time;

(f) a top enclosure hingeably secured onto said main body covering the rolled paper and elements therewithin for protection and structural confinement; and, (g) a compression roller mechanism pivotally attached to the under side of said enclosure in alignment with a continuous paper roll spindle contiguously engaging the open ended paper against the continuous roll paper with sufficient force as to cause the open ended paper to travel along with the rotated driven continuous roll while compensating for the difference in diameter of the continuous roll on the spindle, the entire apparatus allowing a note to be written on the open ended paper and transferred to the continuous roll with the spindles drivingly rotated feeding the paper beyond the device where it may be torn off and used.

2. The main body of the apparatus as recited in claim 1 further comprising a pivotal support leg attached to the bottom of the body and said body having an angled portion on one end of the bottom allowing the entire body to be tilted while resting on the support leg and angle portion for visibility and convenience of writing.

3. The hollow writing platform as recited in claim 1 further comprising said hollow formed with a table surface on the top and a horizontal plate on the bottom allowing a parallel space therebetween for the continuous rolled paper to pass through, a metallic paper tear plate pivotally disposed on a projecting end of the platform having a pair of angular fingers projecting toward the main body and a sharp edge on the end parallel with the platform defining a cutting surface for tearing the open ended roll of paper, and, a platform roller positioned rotatably on the table surface adjacent to the sharp edge of the tear plate providing a bearing area allowing the continuously rolled paper to abruptly change direction and move freely from on top of the table surface to within the hollow.

4. The spindles are recited in claim 1 further comprising a multi-ribbed cylinder having a flange on each end with a round projecting head on the end of one flange and a reactangular drive finger on the other providing an indexing surface for attaching the paper at the onset and confining the paper between the flanges when rolled thereupon.

5. The drive mechanism as recited in claim 1 further comprising:

(a) a gear motor having polarity reversible directional rotation and a drive gear attached to a projecting drive shaft;

(b) a plurality of driven gears positioned rotatably and urgingly to the continuous paper roll on the end of each spindle and in between the gear motor accommodating lateral displacement thereof; (c) a plurality of drive belts contiguously interfacing with the drive and driven gears transmitting torque from the motor to the spindles in a directional manner;

(d) a power supply transmitting electrical energy to the gear motor for operation thereof; and, (f) a plurality of switches, at least one for forward and one for reverse operational rotation providing control of the reversible gear motor by momentarily closing a contact point when manually depressed allowing electrical current to pass therethrough.

6. The power supply as recited in claim 5 further comprising a plurality of direct current storage batteries nested together providing stored electrical energy upon demand, housed within said main body.

7. The power supply as recited in claim 5 further comprising an alternating current to direct current converter with a detachable plug and jack connector, the plug disposed within said main body and the remainder remote from the apparatus.

8. The chirographical note apparatus invention as recited in claim 1 further comprising:

a self-contained calculator having an integral clock and battery power supply with a digital solid state readout removably nested into said top enclosure for indicating the time and allowing mathmatical calculations to be accomplished, a removable calendar having the appropriate days, months, and year attached into said top enclosure under the writing platform when folded outward for writing, and, a writing implement holding depression integral with said top enclosure and adjacent to the calendar for holding a hand writing implement therein.

9. The compression roller mechanism as recited in claim 1 further comprising a metallic weight of ample mass to cause sufficient force to adequately engage the paper on the open ended roll against the continuous roll paper on one of the spindles.

10. The chirographical note apparatus as recited in claim 1 further comprising a plurality of magnets embedded into said top enclosure underneath said writing platform and ferrous metal portion integral with said writing platform such that the hollow writing platform is held in the closed stored position until manually opened.

* * * * *